United States Patent [19]

Wagner et al.

[11] 4,286,261

[45] Aug. 25, 1981

[54] APPARATUS FOR DISCRIMINATING BETWEEN STRAIN AND MAGNETIC STIMULI IN MAGNETIC CORED SOLENOID TYPE TRANSDUCER LINE SENSORS

[75] Inventors: Gilbert F. Wagner, Vienna; J. Louis Berger, Alexandria, both of Va.

[73] Assignee: The United States of America as represented by the Secretary of the Army, Washington, D.C.

[21] Appl. No.: 939,027

[22] Filed: Sep. 1, 1978

[51] Int. Cl.[3] ..... G08B 13/02; G08B 13/22

[52] U.S. Cl. ..... 340/565; 324/327; 340/551; 340/566; 367/136

[58] Field of Search ..... 340/565, 566, 567, 551, 340/38 L, 15.5 A, 15.5 MC, 15.5 TA, 561; 179/82; 324/327, 260; 367/49, 136, 168

[56] References Cited

U.S. PATENT DOCUMENTS

| | | | |
|---|---|---|---|
| 3,302,746 | 2/1967 | Ikrath | 340/566 X |
| 3,573,817 | 4/1971 | Akers | 340/566 X |
| 3,697,745 | 10/1972 | Bolton | 340/551 X |
| 3,812,484 | 5/1974 | Miller et al. | 340/551 |
| 3,961,320 | 6/1976 | Erdmann et al. | 340/566 X |
| 3,967,262 | 6/1976 | Reich et al. | 340/551 |
| 4,038,633 | 7/1977 | King | 340/567 X |
| 4,206,451 | 6/1980 | Kurschner | 340/565 X |

*Primary Examiner*—John W. Caldwell, Sr.
*Assistant Examiner*—Joseph E. Nowicki
*Attorney, Agent, or Firm*—Nathan Edelberg; Robert P. Gibson

[57] ABSTRACT

A dual signature perimeter detection system utilizing an elongated solenoid type transducer having a ferromagnetic core as a line sensor is buried in the ground around an area to be protected against intrusion. One end of the transducer is impressed with constant frequency oscillator signals from a signal generator, while a resistance load impedance is connected across the other end of the transducer at the input side of an amplifier used to pass amplified signals selectively to the inputs of either a bandpass type filter or an A.M. detector, or to both simultaneously, then to their related alarms. The line sensor is sensitive to both magnetic and strain stimuli, but the system hereof, which utilizes dual alarm devices, not only provides for determining the type of stimulus creating the signals, but also improves the sensitivity and response uniformity of the transducer. Optimized oscillator frequency selection, transducer shielding, and subsequent filtering at the input to the electronics collectively minimize false alarms from otherwise potentially greater noise pick-up due to the system's use of an increased bandwidth.

4 Claims, 2 Drawing Figures

APPARATUS FOR DISCRIMINATING BETWEEN STRAIN AND MAGNETIC STIMULI IN MAGNETIC CORED SOLENOID TYPE TRANSDUCER LINE SENSORS

The invention described herein may be manufactured, used and licensed by or for the Government for Governmental purposes without the payment to me of any royalties thereon.

BACKGROUND OF THE INVENTION

The invention relates to magnetic cored solenoid type line sensor systems, and more particularly, to magnetic cored solenoid type sensor systems capable of discriminating between magnetic and strain stimuli.

Perimeter monitoring or protection systems using magnetic cored solenoid type transducer line sensors are well known in the art. In these systems, the magnetic cored solenoid line transducer is buried under the ground around the area that is to be protected against intrusion. Such systems are commonly called perimeter detectors. The transducer will produce output signals when subjected to a magnetic stimulus, a strain stimulus or when subjected to both a magnetic and strain stimuli. The output of the transducer is coupled to suitable electronic circuitry that produces an alarm signal whenever the transducer produces output signals in response to magnetic and/or strain stimuli. Thus, if any intruder that provides magnetic and/or strain stimuli to the transducer approaches or crosses the transducer, an alarm signal is produced by the system.

While the typical prior art systems described above detect any intrusion into the area surrounded by the line transducer, these prior art systems do not discriminate between a magnetic stimulus and a strain stimulus. Thus, while the person monitoring the system is made aware of the fact that an intrusion has occurred, he does not know the nature of the intrusion. That is, he does not know if the alarm was caused by a strain stimulus, a magnetic stimulus, or by both magnetic and strain stimuli. The system of this invention provides a magnetic cored solenoid line transducer system that discriminates between magnetic and strain stimuli. With the apparatus of this invention, the person monitoring the perimeter detection system is made aware of the nature of the intrusion with respect to magnetic and strain stimuli. That is, the system of this invention provides a first output for magnetic stimulus, a second output for strain stimulus and both the first output and the second output when the transducer is subject to both magnetic and strain stimuli. In this manner discrimination between magnetic and strain stimuli is provided with the system of this invention.

SUMMARY OF THE INVENTION

This invention relates to a perimeter detection system in which a magnetic cored solenoid type line transducer is buried in the ground around the area that is to be protected. The transducer is impressed with a constant frequency oscillator signal. Due to the presence of the aforesaid oscillator signal, amplitude modulated signals are produced at the output of the transducer when the transducer is subjected to a strain stimulus and composite signals formed by the linear addition of the oscillator signals and the signals produced by a magnetic stimulus are produced at the output of the transducer when the transducer is subjected to a magnetic stimulus. The amplitude modulated signals and the composite signals are both produced at the output of the transducer when the transducer is subjected to both magnetic and strain stimuli. A filter that rejects the oscillator signals but passes the signals produced by the magnetic stimulus to its output is coupled to the output of the transducer through an amplifier. An A.M. detector that demodulates the amplitude modulated signals produced by a strain stimulus is also coupled to the output of the transducer through the amplifier. If only a magnetic stimulus is present, output signals will be present at the output of the filter but not at the output of the A.M. detector. If only a strain stimulus is present, output signals will appear at the output of the A.M. detector but not at the output of the filter.

An alarm device, which may be an audio alarm, a visual alarm, or both, is coupled to the output of the filter and is activated by the output signals from the filter, thereby providing an indication that the transducer has been subjected to a magnetic stimulus. Similarly, an alarm device, which may be an audio alarm, a visual alarm, or both, is coupled to the output of the A.M. detector and is activated by output signals from the A.M. detector, thereby providing an indication that the transducer has been subjected to a strain stimulus. If a magnetic stimulus and a strain stimulus are impressed on the transducer, both alarms will be activated. In this manner, the system of this invention provides discrimination between magnetic and strain stimuli.

BRIEF DESCRIPTION OF THE DRAWING

A complete understanding of the structure and operation of the invention can be obtained from the following detailed description when read in conjunction with the annexed drawing in which.

DETAILED DESCRIPTION OF THE INVENTION

Figure 1:
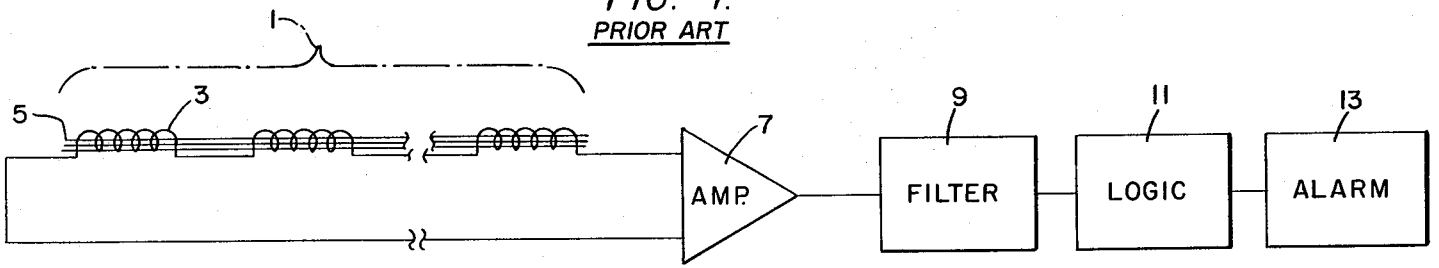
FIG. 1. PRIOR ART
FIG. 1 shows a typical prior art magnetic cored solenoid type line sensor transducer perimeter detector system.

Referring first to FIG. 1, this figure shows a typical prior art perimeter detector system using a magnetic cored solenoid type line sensor transducer 1. Transducer 1 includes the windings 3 and a magnetic core 5. In use transducer 1 is buried in the ground around the area that is to be protected. The output of transducer 1 is coupled to an amplifier 7. The output of amplifier 7 is coupled to a filter circuit 9 and the output of filter circuit 9 is coupled to a logic circuit 11. The output of logic circuit 11 is coupled to an alarm system 13. Alarm system 13 may be an audible or visual alarm or may be both an audio and visual alarm system. Filter circuit 9 and logic circuit 11 are utilized to minimize false alarms that may occur due to ambient noise or stray magnetic fields or the earth's magnetic field variations. Amplifier 7, filter 9, logic circuit 11 and alarm 13 are typically located at some central guard station or post either within the area being protected or remote therefrom.

Transducer 1 is sensitive to both strain and magnetic stimuli. Thus, if a person or object approaches or crosses transducer 1, transducer 1 will generate an output. If the person is not carrying any magnetic material or if the object does not contain any ferromagnetic material, the output produced by transducer 1 will be caused solely by the strain stimuli. If on the other hand, the person approaching or crossing transducer 1 is carrying ferromagnetic material or the object approaching or crossing transducer 1 is made of a ferromagnetic material or materials, the output from transducer 1 will be due to both the strain and the magnetic stimuli. Also, if a magnetic stimulus occurs in the absence of a strain stimulus, transducer 1 will produce an output due solely to the magnetic stimulus. While the system of FIG. 1 will produce an output when transducer 1 is subjected to a magnetic stimulus, a strain stimulus or both strain and magnetic stimuli, the system of FIG. 1 cannot discriminate between magnetic and strain stimuli. Thus, while a person monitoring the system of FIG. 1 is aware of the fact that an intrusion has taken place when alarm 13 is activated, he does not know whether the alarm was caused by a strain stimulus, a magnetic stimulus or both. However, under certain conditions, it may be desirable or necessary to know the nature of the stimulus.

Figure 2:
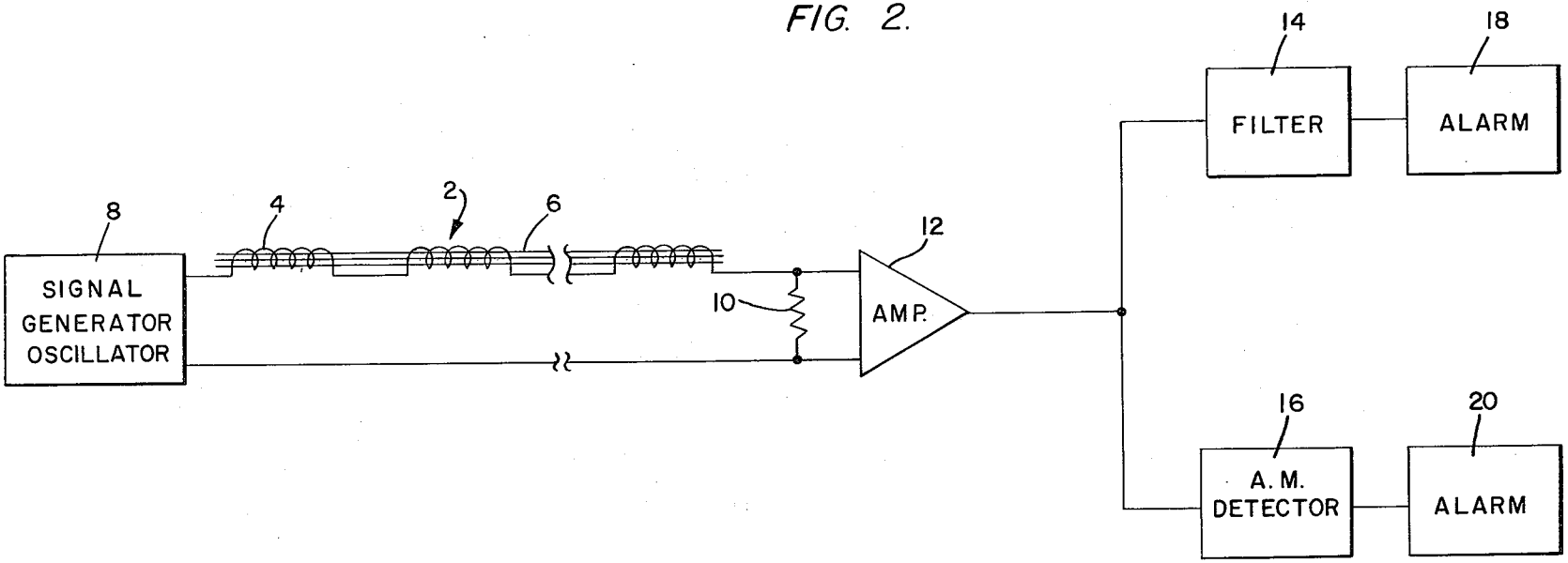
FIG. 2 shows a preferred embodiment of the magnetic cored solenoid type line sensor transducer perimeter detector system of this invention.

With the system of this invention, a preferred embodiment of which is shown in FIG. 2, discrimination between magnetic and strain stimuli is provided. The system of FIG. 2 includes a sensor or transducer 2 having the windings 4 and a magnetic core 6. Transducer 2 is buried in the ground around the area that is to be protected or monitored against intrusion. Constant frequency oscillator signals are impressed on transducer 2 by means of the signal detector 8. A load impedance 10 is connected across transducer 2 and the output of transducer 2 as coupled to the input of the amplifier 12 which also has an output. The output of amplifier 12 is coupled to the input of the filter circuit 14 and to the input of the amplitude modulator (A.M.) detector 16 which is a balanced demodulator. The filter circuit 14 has an output which is coupled to the input of the alarm 18, and the A.M. detector 16 has an output which is coupled to the input of the alarm 20. As shown being utilized in the prior art system of FIG. 1, additional filtering and logic circuitry can be used between the output of filter 14 and the input of alarm 18 and between the output of A.M. detector 16 and the input of alarm 20, if desired, to minimize the chance of a false alarm. However, the novel system of FIG. 2 is not as susceptible to false alarms as is the prior art system of FIG. 1. Further, instead of separate alarms 18 and 20 which may be audio or visual alarms, or both, a single audio and/or visual alarm capable of providing three distinct outputs may be utilized in place of alarms 18 and 20. This single alarm would be coupled to the output of filter 14 and to the output of A.M. detector 16.

Signal generator 8 impresses or applies constant frequency oscillator signals on transducer 2. If transducer 2 is subjected to a magnetic stimulus, the signals produced due to the magnetic stimulus add in a linear fashion to the oscillator signals from generator 8. The resultant signals (pump signals+linearly added magnetic stimulus signals) are amplified by amplifier 12 and passed onto the input of filter 14 and to the input of A.M. detector 16. Since these signals are not amplitude modulated signals, no output signals appear at the output of A.M. detector 16. Filter 14 is chosen to have a passband such that the signals at the oscillator frequency are eliminated. Thus, any output signals from filter 14 will be those signals produced in response to the magnetic stimulus. The output signals from filter 14 due to the magnetic stimulus activate alarm 18.

If signals are produced by transducer 2 due to a strain stimulus, these signals will amplitude modulate the oscillator signals. The amplitude modulated oscillator signal will be amplified by amplifier 12 and the amplified modulated signals are coupled to the input of A.M. detector 16 and filter 14. A.M. detector 16 demodulates the amplitude modulated signals caused by the strain stimulus and produces output signals which activate alarm 20. However, no constant frequency oscillator output signals appear at the output of filter 14 due to the passband of filter 14.

If transducer 2 is subjected to both magnetic and strain stimuli, transducer 2 will provide amplitude modulated signals due to the strain stimulus and signals which are a linear addition of the oscillator signals and the magnetic stimulus signals to the input of amplifier 12. These two sets of signals are amplified by amplifier 12 and alarm 18 is activated by the magnetic stimulus signals that provide an output from filter 14 while alarm 20 is activated by the strain stimulus produced signals that provide an output from A.M. detector 16. Thus, anyone monitoring the system of this invention will know immediately whether an alarm was caused by a magnetic stimulus, a strain stimulus, or both magnetic and strain stimuli. If only a magnetic stimulus is present alarm 18 will be activated. If only a strain stimulus is present, alarm 20 will be activated. If both a magnetic stimulus and a strain stimulus are present, alarms 18 and 20 are both activated.

While the invention has been described with reference to a specific embodiment, it will be apparent to those skilled in the art that various changes and modifications can be made to the specific embodiment shown and described without departing from the spirit and scope of the invention as set forth in the claims.

We claim:

1. A duel signature perimeter detection system comprising in combination:

an elongated solenoid type line transducer having a ferromagnetic core, with said transducer being buried in the ground around an area to be protected, and having an input end and an output end constituting one end and an other end;

means to apply a constant frequency oscillator signal across one end of said transducer;

resistance means connected across the other end of said transducer;

an amplifier having an input coupled to the output of said transducer across said resistance means, said amplifier having an output means;

low frequency characteristic of magnetic signature responsive first detection means coupled to said output means of said amplifier for detecting signals produced by said transducer in response to a magnetic stimulus; and oscillator signal modulated by transducer inductive change responsive second detection means coupled to said output means of said amplifier for detecting signals produced by said transducer in response to a strain stimulus;

said first and second detection means being concurrently operative to indicate perimeter intrusion.

2. A dual signature perimeter detection system as defined in claim 1, wherein said first detection means coupled to said output means of said amplifier for detecting signals produced by said transducer in response to a magnetic stimulus includes input filter means, said input filter means having a bandpass such that said filter means rejects said constant frequency oscillator signals.

3. A dual signature perimeter detection system as defined in claim 2, wherein an alarm device is coupled to said first detection means.

4. A dual signature perimeter detection means as defined in claim 2, wherein said second detection means is an amplitude modulation detection means, and wherein two alarm devices are incorporated, one alarm device being coupled to the output of said input filter means, and the other alarm device being coupled to the output of said second detection means.

* * * * *